US005322078A

United States Patent [19]

Tuttle

[11] Patent Number: 5,322,078

[45] Date of Patent: Jun. 21, 1994

[54] AQUEOUS PARTS WASHING APPARATUS

[75] Inventor: Geoffrey D. Tuttle, Minnetonka, Minn.

[73] Assignee: Kleer-Flo Company, Eden Prairie, Minn.

[21] Appl. No.: 19,035

[22] Filed: Feb. 18, 1993

[51] Int. Cl.[5] ..... B08B 3/04

[52] U.S. Cl. ..... 134/104.4; 134/105; 134/186; 134/195

[58] Field of Search ..... 134/104.4, 105, 107, 134/111, 135, 186, 191, 195, 198, 199, 200

[56] References Cited

U.S. PATENT DOCUMENTS

| | | | |
|---|---|---|---|
| 1,545,979 | 7/1925 | Rosenberg | 134/104.4 |
| 1,826,015 | 10/1931 | Morton | 134/104.4 X |
| 2,646,585 | 7/1953 | Whittington | 134/198 X |
| 3,020,918 | 2/1962 | Albertson et al. | 134/111 X |
| 3,522,814 | 8/1970 | Olson | 134/111 |
| 4,056,114 | 11/1977 | Boutillette | 134/111 X |
| 4,120,547 | 10/1978 | Price et al. | 134/104.4 X |
| 4,135,530 | 1/1979 | Cheney | 134/60 |
| 4,505,284 | 3/1985 | Ryatt | 134/111 X |
| 4,543,182 | 9/1985 | Gramse et al. | 134/111 X |
| 4,692,251 | 9/1987 | Hilgren . | |
| 4,895,649 | 1/1990 | Brandt et al. . | |
| 4,911,190 | 3/1990 | Sheldon | 134/111 X |
| 4,966,693 | 10/1990 | Brandt et al. . | |
| 5,091,081 | 2/1992 | Hilgren . | |
| 5,107,876 | 4/1992 | Ozyjiwsky | 134/111 |
| 5,232,299 | 8/1993 | Hiss | 401/143 |

FOREIGN PATENT DOCUMENTS

| | | | |
|---|---|---|---|
| 2449056 | 3/1976 | Fed. Rep. of Germany . | |
| 51591 | 4/1979 | Japan | 134/104.4 |
| 553319 | 5/1943 | United Kingdom . | |

*Primary Examiner*—Philip R. Coe

*Attorney, Agent, or Firm*—Merchant, Gould, Smith, Edell, Welter & Schmidt

[57] ABSTRACT

An aqueous parts washing machine includes a main tank and a submersion tank disposed within the main tank. The submersion tank is supported in spaced relation from the walls and floor of the main tank. An aqueous cleaning solution fills the submersion tank and partially fills the main tank. A pumping system circulates the cleaning solution within the submersion and main tank. The pumping system includes a pump for drawing solution from the main tank and a solution agitation member for receiving solution from the pump and injecting the solution into the submersion tank to agitate solution within the submersion tank. The pumping system further includes a sparging mechanism for projecting solution from the pump across an upper surface of solution within the submersion tank to skim an oil deposit on the upper surface over an edge of the submersion tank.

9 Claims, 3 Drawing Sheets

AQUEOUS PARTS WASHING APPARATUS

BACKGROUND OF THE INVENTION

1. Field of the Invention

This application pertains to an apparatus for washing (e.g., machine parts) parts. More particularly, this invention pertains to such an apparatus which uses an aqueous washing solution.

2. Description of the Prior Art

In the machine tool industry, it is necessary to clean machined parts after they have been manufactured. Typically, during the machining process, cooling oils and other fluids are applied to the parts during the machining process. These oils and fluids must be cleaned from the parts before inventory and shipment. Also, parts cleaning is needed in other industries (e.g., the automobile service industry and maintenance industries).

In the past, cleaning solutions were primarily petroleum distillates. However, due to environmental concerns, the industry has moved to a preference for aqueous cleaning solutions. The use of aqueous solutions has provided a need to heat the solution to increase its cleaning capability as well as means to remove oils from the solution.

A typical parts washer may include a submersion tank which is placed within a larger tank of cleaning fluid. It is desirable to provide a mechanism to permit ready access to all internal elements for maintenance and cleaning.

It is an object of the present invention to provide an aqueous parts washer which efficiently removes oil contaminants and permits ready assembly and disassembly for purposes of maintenance and cleaning.

SUMMARY OF THE INVENTION

According to a preferred embodiment of the present invention, an aqueous parts washing apparatus is provided. The apparatus includes a main tank which defines a first volume. A submersion tank defining a smaller second volume is provided. The submersion tank is sized to be inserted into the first volume of the main tank. A support mechanism is provided for supporting the submersion tank within the main tank. When supported, the floor of the submersion tank is spaced from the floor of the main tank. An aqueous cleaning solution fills the submersion tank and partially fills the main tank. A pumping system circulates the solution within the submersion and main tanks. The pumping system includes a pump for drawing solution from the main tank. An agitator is provided for receiving solution from the pump and injecting the solution into the submersion tank to agitate the solution within the submersion tank. A sparging mechanism is provided for projecting solution from the pump across an upper surface of solution within the submersion tank, thereby skimming oil deposits on the upper surface over an edge of the submersion tank.

DESCRIPTION OF THE PREFERRED EMBODIMENT

Figure 1:
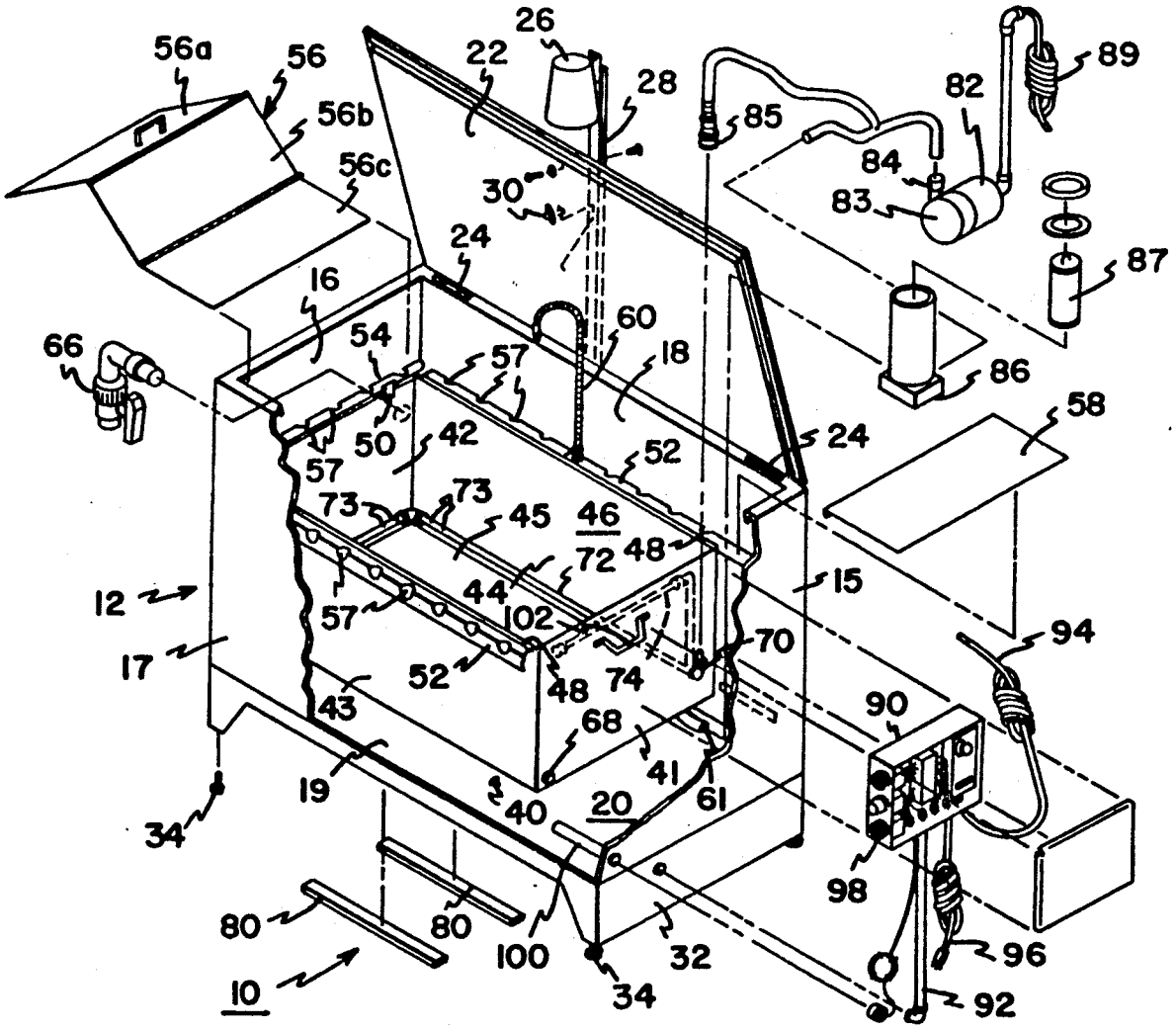
FIG. 1 is an exploded perspective view, partially in section, of the parts washing apparatus of the present invention.

With reference now to the various drawings in which identical elements are numbered identically throughout, a description of the preferred embodiment will now be provided.

The present invention is an aqueous parts washing apparatus 10. The apparatus includes a main tank 12 having (with reference to the view of FIG. 1) a right end wall 15, a left end wall 16, a front wall 17, and a back wall 18. A floor or bottom wall 19 connects walls 15–18 to define a volume 20.

The main tank 12 is open at its top. A cover 22 is pivotally secured to the back wall 18 by hinges 24 such that cover 22 may be pivoted to a down position to cover the volume 20 and may be pivoted to an up position (shown in FIG. 1) to permit access to the volume 20.

A work lamp 26 is positioned over the apparatus 10 by a support column 28. The cover 22 may be releasably retained in the up position by fastening to the column 28 by a latch 30.

In a preferred embodiment, latch 30 is a so-called fusible link made of low melting point metal. In the event of fire, latch 30 melts causing cover 22 to fall to the closed position. This covers the tank 12 to help extinguish any fire that might be in tank 12.

A base 32 is secured to the bottom wall 19. Levelling screws 34 extend from the bottom of the base 32 to permit an operator to control the level position of the main tank 12 on a horizontal foundation (not shown).

A submersion tank 40 is provided. The submersion tank 40 includes a right end wall 41, a left end wall 42, a front wall 43 and a rear wall 44. The walls 41–44 are connected by a floor 45 to define a volume 46 of the submersion tank. The volume 46 is sized to receive a basket (not shown) containing parts to be washed.

As shown in the drawings, the submersion tank 40 is sized to be received within the volume 20. Extending from walls 43 and 44 are upper flanges 48. The flanges 48 rest on mounting brackets 52 secured to the interior surfaces of walls 17,18.

A mounting bracket 54 is secured to end wall 16. Wall 42 is hinged to bracket 54 by a hinge plate 50.

When the submersion tank 40 is inserted within the volume 20, the flanges 48 rest on mounting brackets 52. The mounting brackets 52–54 are provided with openings 57 cut therein to permit fluid to spill over the work shelf 56 into the main tank 12 as needed.

Figure 2:
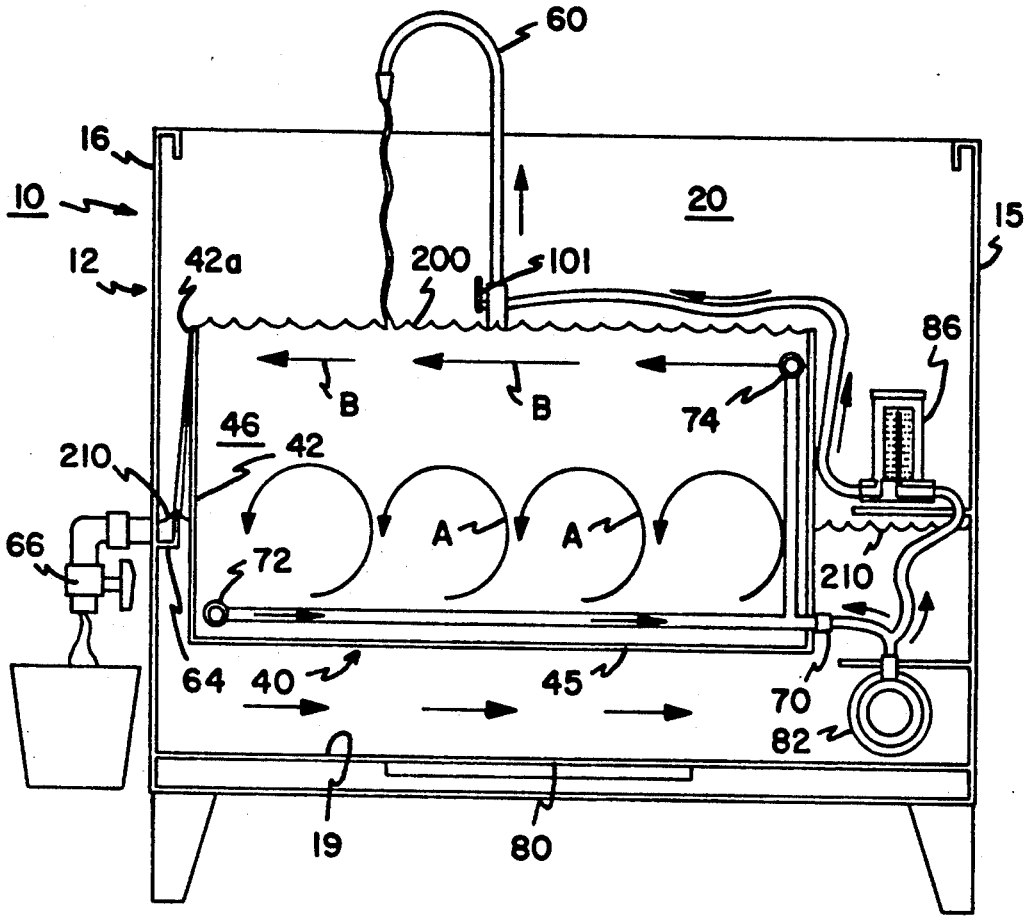
FIG. 2 is a schematic side sectional view of the apparatus of FIG. 1.
Figure 5:
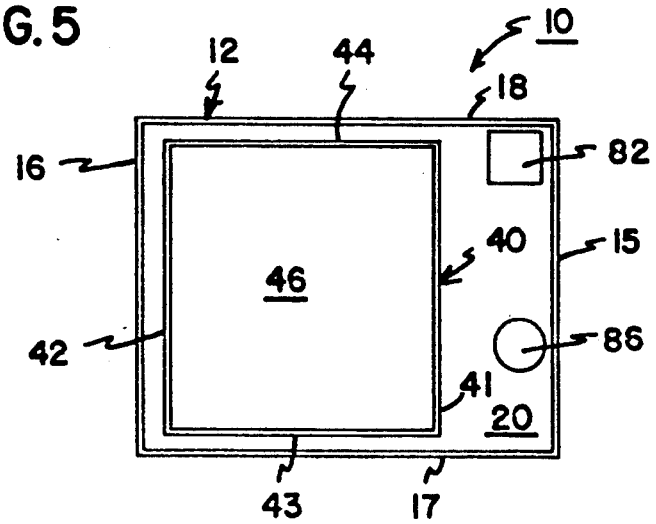
FIG. 5 is a top plan schematic view of the apparatus of FIG. 1.

As shown in the drawings (e.g. FIGS. 2 and 5), the submersion tank 40 is sized such that when it is inserted, the walls (41–44) of the submersion tank 40 are spaced from the walls 15–18 of the main tank 12 and the floor 45 of the submersion tank 40 is spaced from the floor 19 of the main tank 12. This spacing provided thermal insulation for submersion tank 40 (i.e., the space between floor 19 and floor 45 is filled with heated cleaning solution).

Figure 4:
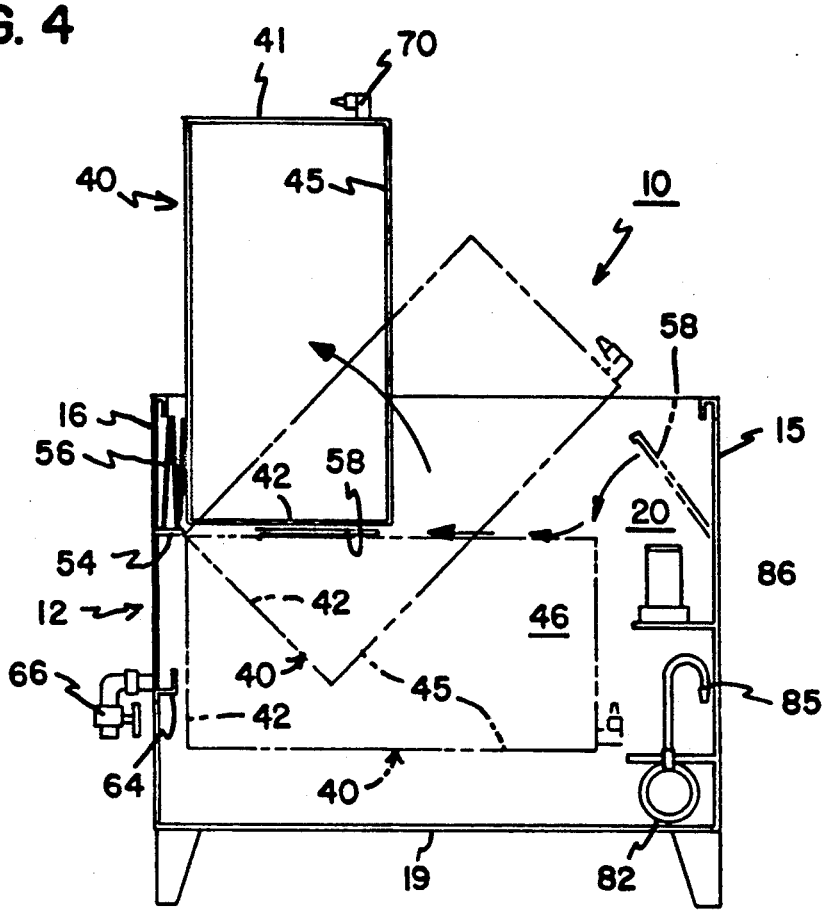
FIG. 4 is the view of FIG. 3 showing a submersion tank in an upright position with alternative positions shown in phantom.

A collapsible cover 56 is provided to cover the submersion tank 40 with the cover 56 resting on flanges 48 and brackets 52,54. The cover 56 is comprised of a plurality of hinged panels 56*a*, 56*b*, 56*c* such that the panels may be collapsed on one another with the cover 56 placed against the end wall 16 to permit an operator to have access into the volume 46 (FIG. 4).

As can be seen in the drawings, the submersion tank 40 is inserted within the main tank 12 with end wall 42 placed in close proximity to end wall 16. End wall 41 is placed substantially spaced from end wall 15. A shelf 58 is provided sized to rest on flanges 48 with the shelf covering the space between end wall 15 and end wall 41.

A flexible hose 60 is secured to the main tank back wall 18. The flexible hose 60 is connected to a hose inlet 61 disposed in the main tank beneath the floor of the submersion tank 40.

An oil skimming weir 64 (illustrated best in FIG. 2) is secured to the inner surface of end wall 16 beneath mounting bracket 54. Fluid flows over upper edge 42*a* of wall 42. In operation, this flow returns to tank 12 and is subsequently skimmed off by weir 64. A drain 66 is connected to the weir to permit fluid from the weir to be drained from the apparatus 10.

The end wall 41 of the submersion tank 40 is provided with a drain 68 disposed near the floor of the submersion tank. Similarly, a fluid inlet in the form of a coupling nipple 70 is provided secured to end wall 41.

The submersion tank 40 is provided with internal plumbing which includes an agitation system 72. The agitation system 72 is piping surrounding the perimeter of the interior of the submersion tank 40 adjacent the floor 45. The piping has a plurality of holes 73 (only a few of which are shown in FIG. 1) such that a fluid applied to the interior of the piping under pressure is forced out of the holes 73 to agitate any fluid which may be contained within the submersion tank 40. The piping is connected to the coupling nipple 70 to receive a fluid under pressure. Also connected to coupling nipple 70 is a sparging bar 74. The sparging bar is disposed extending between side walls 43,44 adjacent end wall 41 and adjacent the top of the submersion tank 41. The sparging bar 74 is a pipe having holes formed along its length and directed to project a fluid along a path (arrows B) generally parallel to the upper surface 200 of fluid within the submersion tank 40 toward end wall 42 (see FIG. 2).

Heating strips 80 are secured to the under surface of floor 19. The heating strips 80 are electrically operated such that the passage of a current through the heating strips 80 heats the strips, which in turn heat the stainless steel floor 19, to heat any fluid which may be contained within the main tank 12.

A pump 82 is contained within the main tank and has a fluid inlet 83 for drawing fluid from the main tank and forcing fluid out of an outlet 84. The outlet 84 is connected via a coupling 85 to the nipple 70. The outlet 84 is connected to the inlet 61 of the flexible hose 60. Intermediate the outlet 84 and the flexible hose inlet 61 is a filter assembly 86 containing filter 87.

The control system of the apparatus includes an electrical control box 90 mounted exterior of the tank 12. The control box is coupled through an electrical conduit 92 to the heating elements 80. The pump is connected via an electrical conduit 89 to the control box 90. Also, the control box includes an electrical supply line 94 to the lamp 26. The control box includes a plug 96 for connection to an exterior source of power such as an outlet. Operator control knobs 98 are mounted on the control box to permit an operator to activate the heating elements 80, the lamp 26 and the pump 82. A thermocouple 100 connected to box 90 senses the temperature of fluid in tank 12. The flexible hose 60 is provided with a valve 101 (FIG. 2) to permit an operator to control the flow of fluid through the hose 60.

In operation, an aqueous cleaning solution is placed within the submersion tank 40 to fill the submersion tank 40 to a first predetermined level 200. The cleaning solution is also placed in the main tank such that it assumes a level 210 above the floor 45 of the submersion tank 40. The heating bars 80 are energized to heat the fluid within the main tank 12 which, in turn, heats the fluid within the submersion tank 40. The pump 82 is energized which forces the cleaning solution through the agitator system 72 to cause an agitation (illustrated by arrows A in FIG. 2) of cleaning solution within the submersion tank 40. Simultaneously, a spray (illustrated by arrows B in FIG. 2) of the cleaning solution is sprayed from the sparging bar 74 toward wall 42. The spray B will continuously push floating oils on the surface 200 of the solution within the submersion tank 40 over the top edge 42*a* of the submersion tank left wall 42. Oil-contaminated solution pushed off of the surface 200 of the submersion tank 40 passes over upper edge 42*a* and is discharged into tank 12 for subsequent collection within the weir 64. The oil-contaminated solution can then be drawn away from the weir 64 through the drain 66.

The leveling screws 34 may be field adjusted so that floor 19 is not level but with the left side of the apparatus 10 (as viewed in FIG. 2) lower than the right side to facilitate flow toward weir 64.

Dirty parts to be cleaned are placed in a basket (not shown) which is submerged within the submersion tank 40. The cover 56 is placed covering the submersion tank and the parts may be left unattended to be cleaned. If desired, an operator may open valve 101 to permit cleaning fluid to be forced through the hose 60 to clean individual parts as desired.

The apparatus 10 provides two levels of cleaning. Parts can be submerged within tank 40 and cleaned through agitation provided by agitation system 72. Simultaneously, with cover 56 in place, parts can be cleaned by hand beneath hose 60. In this usage, the flow from hose 60 drains into tank 12 through openings 57.

Figure 3:
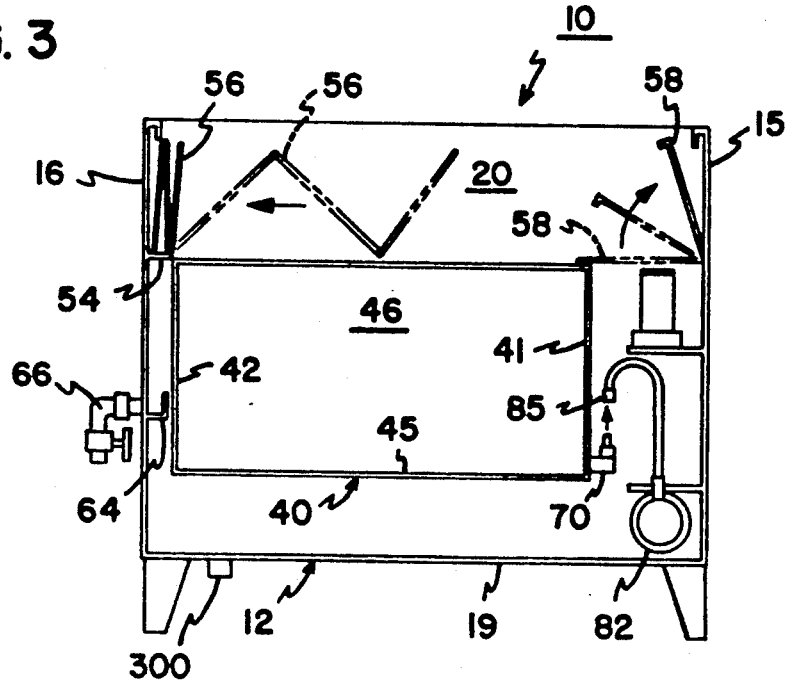
FIG. 3 is the view of FIG. 1 with a foldable cover and a second cover shown in phantom in alternative positions.

From time to time it is desirable to have access to the interior of the apparatus. Accordingly, fluid can be drained from both the submersion tank 40 and the main tank 12 by opening drain 68 and a drain 300 (shown only schematically in FIG. 3) in tank 12. The cover 56 is placed in its collapsed position as shown in FIG. 4.

Also, it is desirable the agitation system 72 have an anti-syphon device to prevent back flow from tank 40 toward pump 82 when pump 82 is not operating. This can be done through numerous means (e.g., providing a check valve in agitation system 72).

When the fluid is completely drained from the submersion tank 40 and the main tank 12, an operator disconnects coupling 85 from coupling nipple 70. The operator then grasps handle 102 and pivots the submersion tank to the upright position shown in FIG. 4. The submersion tank 40 is pivoted about hinge plates 50 (shown only in FIG. 1). To retain the submersion tank in the upright position, the shelf 58 is repositioned beneath the end wall 42 of the submersion tank to support it in its upright position. The shelf 58 rests upon mounting brackets 52 (see FIG. 1) to support the weight of tank 40. An operator then has unobstructed access to the interior of the main tank.

An alternative use is to drain tank 40 and fill tank 12. Cleaning fluid can then be sprayed under pressure into tank 40 to clean parts in tank 40.

From the foregoing detailed description of the present invention, it has been shown how the objects of the invention have been attained in a preferred manner. However, modifications and equivalents of the disclosed concepts such as those which readily occur to one skilled in the art are intended to be included within the scope of the claims of the invention.

What is claimed is:

1. An aqueous parts washing apparatus for washing parts contaminated with oil, said apparatus comprising:

a main tank defining a first volume with said main tank having a first open top;

a submersion tank defining a second volume with said submersion tank having a second open top, said submersion tank sized to be inserted through said first open top into said first volume;

support means for supporting said submersion tank within said main tank and with a floor of said submersion tank spaced from a floor of said main tank;

an aqueous cleaning solution at least partially filling said main tank;

solution pumping system for circulating said solution between said submersion and main tanks, said solution pumping system means including:

(a) a pump for drawing solution from said main tank; and (b) solution sparging means for projecting solution from said pump across an upper surface of said solution within said submersion tank and skimming said oil along said upper surface over an edge of said submersion tank.

2. An apparatus according to claim 1 comprising means for directing said skimmed oil from said edge and into said main tank, a weir disposed within said main tank to skim said oil from a surface of said solution within said main tank and drain means for draining said skimmed oil from said weir.

3. An apparatus according to claim 2 comprising levelling means for controlling the level of said main tank on a support foundation with said main tank inclined toward said weir.

4. An apparatus according to claim 1 comprising heating means for heating said solution within said main tank.

5. An apparatus according to claim 1 wherein said submersion tank is pivotal within said main tank to an upright position with said second open top generally vertical; temporary support means for releasably supporting said submersion tank in said upright position.

6. An apparatus according to claim 1 wherein said submersion tank is sized and supported for side walls of said submersion tank to be spaced from side walls of said main tank.

7. An apparatus according to claim 1 wherein said solution within said main tank is provided at a level in contact with said floor of said submersion tank.

8. An apparatus according to claim 1 wherein said pump is disposed within said main tank, said solution sparging means releasably connected to an output of said pump.

9. An apparatus according to claim 1 wherein said pumping system includes agitation means for receiving solution from said pump and injecting said solution within said submersion tank to agitate said solution within said submersion tank.

* * * * *